US008598814B2

(12) United States Patent
Möller et al.

(10) Patent No.: US 8,598,814 B2
(45) Date of Patent: Dec. 3, 2013

(54) LINEAR ACCELERATOR

(75) Inventors: Marvin Möller, Jena (DE); Sven Müller, Urbich (DE); Stefan Setzer, Fürth (DE)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 13/463,655

(22) Filed: May 3, 2012

(65) Prior Publication Data

US 2012/0280640 A1 Nov. 8, 2012

(30) Foreign Application Priority Data

May 4, 2011 (DE) ..... 10 2011 075 210

(51) Int. Cl.
*H05H 9/00* (2006.01)

(52) U.S. Cl.
USPC ..... 315/505; 315/500; 315/502; 315/506; 313/505; 313/5.41

(58) Field of Classification Search
USPC ..... 315/500–507; 313/505, 5.41
See application file for complete search history.

(56) References Cited

U.S. PATENT DOCUMENTS

| | | | | |
|---|---|---|---|---|
| 4,293,772 | A | 10/1981 | Stieber | |
| 5,744,919 | A * | 4/1998 | Mishin et al. | 315/505 |
| 6,465,957 | B1 * | 10/2002 | Whitham et al. | 315/5.41 |
| 7,112,924 | B2 * | 9/2006 | Hanna | 315/5.41 |
| 7,130,371 | B2 * | 10/2006 | Elyan et al. | 378/57 |
| 7,906,770 | B2 * | 3/2011 | Otto | 250/492.3 |
| 2004/0202272 | A1 * | 10/2004 | Yao et al. | 376/120 |
| 2007/0018111 | A1 | 1/2007 | Calderon et al. | |
| 2007/0269013 | A1 | 11/2007 | Liu et al. | |
| 2010/0034355 | A1 * | 2/2010 | Langeveld et al. | 378/95 |
| 2010/0188027 | A1 | 7/2010 | Treas et al. | |
| 2010/0201240 | A1 * | 8/2010 | Heinke et al. | 313/35 |
| 2011/0121763 | A1 * | 5/2011 | Sadler et al. | 315/505 |
| 2012/0086364 | A1 * | 4/2012 | Guethlein | 315/505 |
| 2012/0126727 | A1 * | 5/2012 | Hamm | 315/505 |
| 2012/0235603 | A1 * | 9/2012 | Heid | 315/505 |

FOREIGN PATENT DOCUMENTS

| | | | |
|---|---|---|---|
| DE | 10 2004 055 256 | B4 | 9/2006 |
| DE | 10 2007 020 984 | A1 | 11/2007 |
| DE | 10 2009 007 218 | A1 | 9/2010 |
| EP | 0 037 051 | | 10/1981 |
| WO | WO 2011/094475 | A1 | 8/2011 |

OTHER PUBLICATIONS

German Office Action dated Mar. 9, 2012 for corresponding German Patent Application No. DE 10 2011 075 210.2 with English translation.

R. Stock., "Encyclopedia of Applied High Energy and Particle Physics," Weinheim: Wiley-VCH, pp. 495-531, 2009.

* cited by examiner

*Primary Examiner* — Douglas W Owens
*Assistant Examiner* — Srinivas Sathiraju
(74) *Attorney, Agent, or Firm* — Lempia Summerfield Katz LLC

(57) ABSTRACT

A method for pulsed operation of a linear accelerator includes generating pulses of charged particles. The generating includes emitting particles by a particle source and accelerating the particles in an accelerator device that includes a plurality of linked cavity resonators. The accelerator device is supplied with energy by an energy supply unit. Particle energy is changed solely by varying a number of particles emitted by the particle source per pulse.

18 Claims, 2 Drawing Sheets

LINEAR ACCELERATOR

This application claims the benefit of DE 10 2011 075 210.2, filed on May 4, 2011.

BACKGROUND

The present embodiments relate to a method for pulsed operation of a linear accelerator.

DE 10 2009 007 218 A1 discloses an electron accelerator for generating photon radiation. Such an electron accelerator may, for example, be used for radiation therapy or for nondestructive materials testing. The electron accelerator includes an electron source and a vacuum chamber, in which electrons emitted by the electron source are accelerated. Nothing is stated in DE 10 2009 007 218 A1 about a possible time structure of the electron beam generated.

EP 0 037 051 A1 discloses an accelerator for charged particles (e.g., electrons) that is provided for the emission of a particle beam. The particle beam may be used either directly as an electron beam or for generating X-ray radiation.

Another electron source is, for example, known from DE 10 2004 055 256 B4. In this case, a resonator of the electron source (e.g., a high-frequency electron source) is formed from superconducting material.

In medical engineering, for accelerators that are operated in pulse mode, a distinction is made between micropulses and macropulses. The micropulses are determined by the physical properties of the accelerator tube and have a duration of, for example, a few 10-100 picoseconds. A macropulse may be composed of several thousands or tens of thousands of micropulses and have a duration of a few microseconds. The time interval between two macropulses may be a few milliseconds, so that the pulse frequency of the accelerator is a few hundred Hz.

SUMMARY AND DESCRIPTION

The present embodiments may obviate one or more of the drawbacks or limitations in the related art. For example, a pulsed particle beam is generated by a linear accelerator.

The embodiments explained below apply for a device (e.g., the linear accelerator), a method, with which the linear accelerator is operated, and software, with which the method may be realized in interaction with the device.

The method for pulsed operation of a linear accelerator includes the following features. Pulses of charged particles are generated, in that particles are emitted by a particle source and are accelerated in an accelerator device that includes several linked cavity resonators. The accelerator device is supplied with energy by a high-frequency energy supply.

With the high-frequency power fed to the accelerator device being kept completely or at least approximately constant, the particle energy (e.g., the energy per particle after passing through the accelerator device) is changed solely by varying the number of particles emitted by the particle source per macropulse.

The number of particles emitted by the particle source is also referred to as the beam loading or beam current.

The present embodiments are based on the consideration that high-frequency power fed to a particle accelerator made up of linked cavity resonators may be approximately constant during operation of the accelerator, or at least is not subject to significant changes from one particle pulse to another. Assuming a constant high-frequency power, an acceleration voltage, with which the particles are accelerated to an energy of, for example, several MeV when passing through the cavity resonators, is a function of the beam current. The following ratio may apply:

$$P_{in}=U*I+U^2/R_v$$

where $P_{in}$=injected high-frequency power

U=acceleration voltage

I=beam current $R_v$=loss resistance

For the acceleration voltage, this produces:

$$U=(P_{in}*R_v+0.25*I^2*R_v^2)^{1/2}-0.5*I*R_v$$

An increase in the beam loading (e.g., the particles emitted per time unit and accelerated by the cavity resonators) accordingly results in a diminution in the acceleration voltage and thus to a reduction in the kinetic energy that the particles have after passing through the accelerator. A change in energy of the accelerated particles is thus achieved by a change in the loading.

In addition to the described effect of the change in loading, another effect (e.g., adjustment of the impedance) plays a role in the desired change in particle energy by changing the beam current.

By changing the beam current, the load resistance (impedance) of the particle accelerator changes, whereupon the adjustment of the impedance of the accelerator to the high-frequency source also changes. Such a change in the adjustment of the impedance provides a change in the reflection factor of the accelerator. The power coupled into the accelerator depends on the adjustment of the impedance and thus on the beam current.

This dependency may be used to control the particle energy if the linear accelerator is suitably configured, in that the power coupled into the accelerator diminishes as the beam current increases. The effect of the impedance maladjustment thereby increases the effect of the change in loading. In order to achieve an optimal interaction of the two effects (e.g., change in loading and adjustment of the impedance), the linear accelerator may be configured such that the impedance of the accelerator device is adjusted to the particle source at a minimum particle stream (e.g., theoretically, at zero beam current). This provides that the high-frequency power coupled into the accelerator device is maximum at the lowest beam current and continuously decreases as the beam current increases.

Due to the mutually reinforcing effects of change of loading and adjustment of the impedance, a change in the energy of the accelerated particles of more than 1 MeV (e.g., of more than 2 MeV) may be achieved.

In one embodiment, the linear accelerator is configured to accelerate the particles to an energy between 0.5 MeV and 20 MeV.

The particle source may be an electron source. The present embodiments may also be implemented with accelerators that accelerate any other charged particles (e.g., protons or ions). Even though in the following an electron source is cited as a particle source, a corresponding technical function may likewise be achieved with accelerators for other electrically charged particles.

In the case of an electron source, the beam current and thereby the energy of the accelerated electrons may be varied by changing, for example, the grid voltage of the electron gun (e.g., of the particle source). In a configuration, this variation is possible in a matter of milliseconds. A selective change in the electron energy from pulse to pulse is thereby possible. Other changes in the control of the particle source or of the accelerator downstream thereof, supplied with power by a high-voltage source, are not provided in order to change the electron energy. The clock frequency of the electron pulses lies in the range from 1 to 1000 Hz. In one embodiment, the clock frequency of the electron pulses may be above 100 Hz. These are macropulses, which are distinguished from micropulses, as explained in the introduction.

According to one embodiment, a control device provided for controlling the particle source is configured to generate a particular dose rate per pulse of emitted particles while keeping the high-frequency power fed to the accelerator device absolutely or at least largely constant (e.g., optionally, in the case of a first lower particle energy or in the case of a second higher particle energy). The provision of a particular, constant dose rate is achieved by two effects simultaneously working in opposite directions: as the beam current increases, the number of particles per time unit increases, but the energy per particle drops. The operating unit provided for operation of the linear accelerator (e.g., software) offers the user who sets a desired dose rate a choice between two particle energies, with which this dose rate is achieved.

The advantage of the present embodiments may be, for example, in that the energy of the individual particles emitted by a linear accelerator (e.g., an electron accelerator) may be varied easily and with a high rate of change. Only the beam current may be changed, while all other operating parameters may be kept.

DETAILED DESCRIPTION OF THE DRAWINGS

Figure 1:
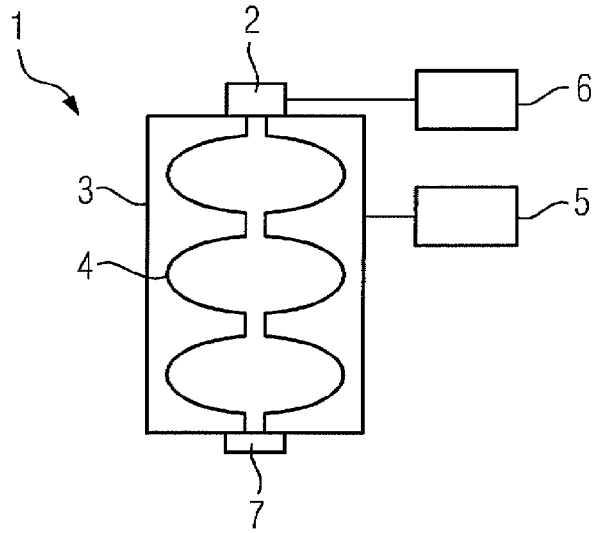
FIG. 1 is a schematic illustration of one embodiment of a linear accelerator.

A linear accelerator characterized overall by reference character 1 includes an electron source 2 (e.g., designated a particle source) and an accelerator device 3 operable for accelerating emitted electrons. The accelerator device 3 has several linked cavity resonators 4. Regarding the function of the linear accelerator 1 (e.g., the electron accelerator), reference is made to the prior art cited in the introduction.

The accelerator device 3 is supplied with high-frequency power by an energy supply unit 5 supplying high-frequency power. A control device 6 is provided for controlling the electron source 2. The control device 6 permits a pulsed operation of the electron source 2 and a variation in the pulses (e.g., a change in the number of electrons emitted per pulse). The pulsed emission of electrons produces a beam current, a quantity of which is designated as a beam current strength. The electron beam emitted by the electron source 2 and raised to an increased energy level by the accelerator device 3 hits an exit window 7 lying opposite the electron source 2 and closing the accelerator device 3, in order to be used either directly as an electron beam or for generating electromagnetic radiation (photons).

An interval between two consecutive pulses of the electron source 2 (e.g., between two macropulses) is a few milliseconds, corresponding to a pulse frequency of a few hundred Hz. The linear accelerator 1 is configured to change the beam current selectively from one pulse to the next in order to vary the energy per electron accelerated by the accelerator device 3 per macropulse, as required. The variation of the electron energy from pulse to pulse is effected solely by the control device 6 controlling the electron source 2. No active change is thereby made at the high-frequency supply supplying the accelerator device 3 with energy (e.g., at the energy supply unit 5).

The electron source 2 and the accelerator device 3 are aligned with one another such that the adjustment of an impedance during no-load running (e.g., zero beam current) is optimal. As the beam current increases, the adjustment of the impedance deteriorates, as desired, in order to selectively reduce the electron energy. The effect of change of loading as the beam current increases (e.g., as the number of electrons emitted by the electron source 2 per pulse increases) is added to the effect of the adjustment of the impedance. This helps to reduce the electron energy.

Figure 2:
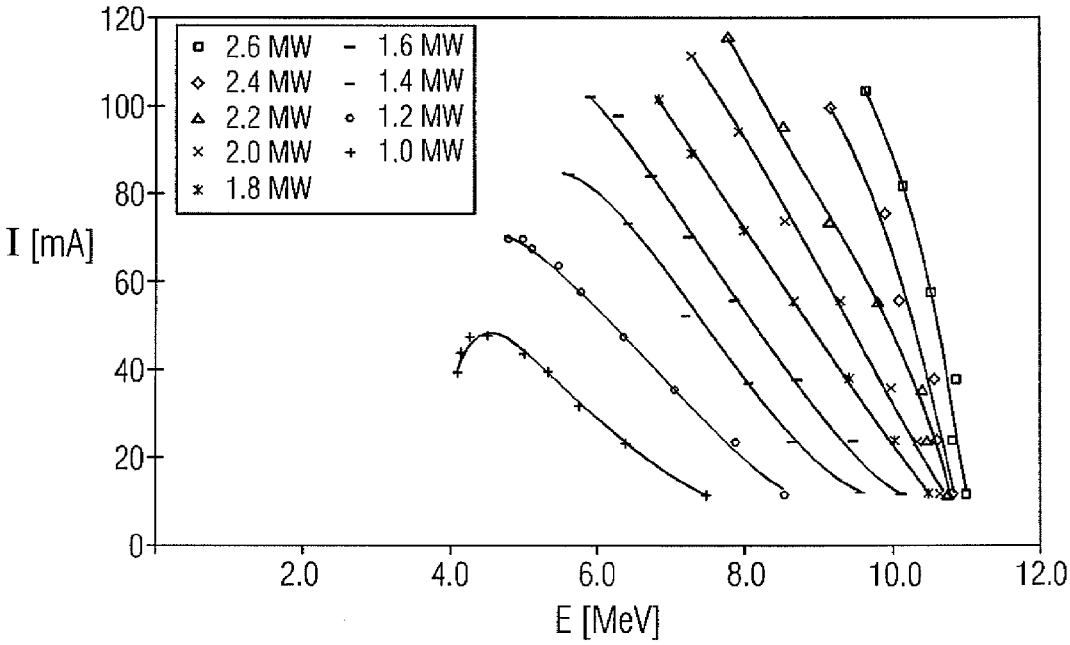
FIG. 2 is a diagram of the exemplary dependency between beam current and electron energy in one embodiment of the linear accelerator according to FIG. 1.

The relationship between an energy E of the electrons emitted by the linear accelerator 1 (e.g., nominal energy in MeV) and the beam current I (e.g., "beam" in mA) is illustrated in FIG. 2 for different powers (e.g., 1.0 MW to 2.6 MW). In a median power range between 1.4 MW and 2.0 MW, the characteristic of the energy reduction is approximately linear in the case of an increasing beam current I. For example, at a power of the exemplary linear accelerator 1 of 1.8 MW, the energy E of the electrons may be adjusted only by changing the beam current I between less than 8 MeV and more than 10 MeV. Because of this change in the electron energy E, the electron energy E may be varied both quickly and precisely with relatively little instrument-based effort. Only operating parameters of the electron source 2 and not those of the energy supply unit 5 of the accelerator device 3 are adjusted for the variation. The resulting possible continuous change or gradual adjustment of the electron energy is suitable both for medical engineering applications and for industrial applications of the linear accelerator 1.

Figure 3:
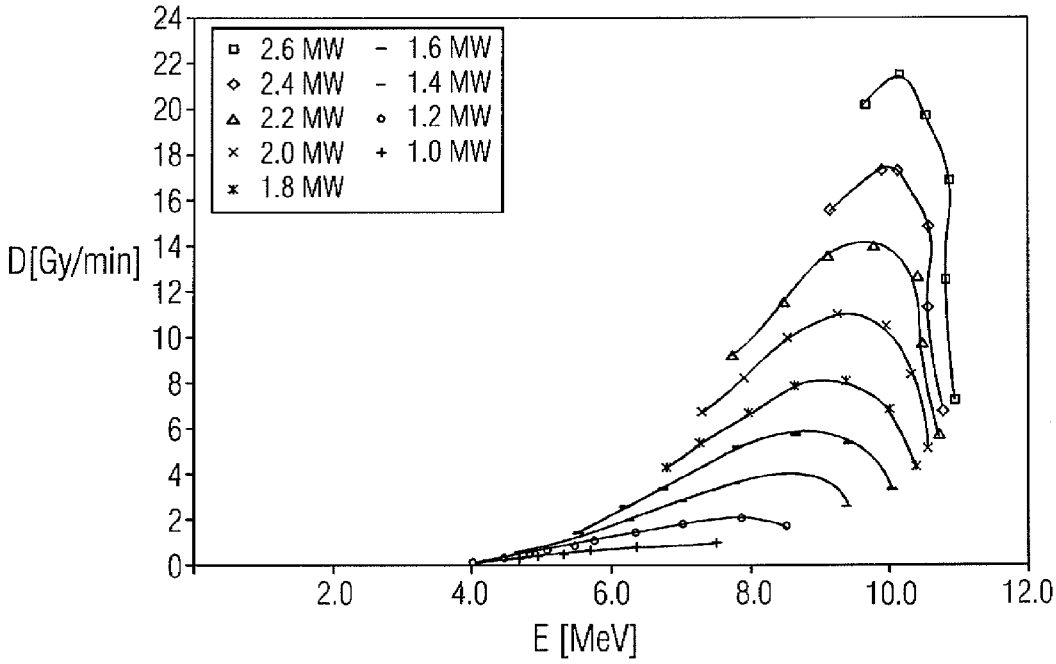
FIG. 3 is a diagram of the exemplary dependency between electron energy and dose rate in one embodiment of the linear accelerator according to FIG. 1.
Figure 4:
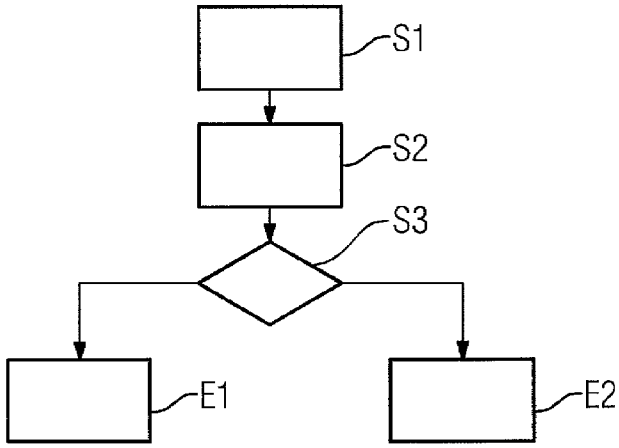
FIG. 4 is a flow chart of various possible settings for one embodiment of the linear accelerator according to FIG. 1.

FIG. 3 illustrates, again for powers between 1.0 MW and 2.6 MW, a maximum dose rate D in Gray/min emitted by the linear accelerator 1 under certain test conditions at a pulse frequency of 300 Hz. For example, in the median and upper power range, a desired (e.g., identical) dose rate D may optionally be provided at a first lower electron energy E or at a second higher electron energy E. This selection option is user-friendly in terms of software, as illustrated in FIG. 4.

The program startup designated by S1 is followed by act S2, in which the operator of the linear accelerator 1 inputs parameters. For example, an operator inputs the desired dose rate. Act S3 includes a query, in which the program checks whether the dose rate input may be realized with different energy settings, related to the energy of the electrons on leaving the accelerator device 3. If the dose rate input may be realized with different energy settings, the program offers the operator the corresponding selection and accordingly effects either a first lower energy setting E1 of, for example, 8 MeV or a second higher energy setting E2 of, for example, 10 MeV. A switchover between the two possible energy settings E1, E2 is effected, where appropriate, as described above, by a change in the beam current emitted by the electron source 2.

While the present invention has been described above by reference to various embodiments, it should be understood that many changes and modifications can be made to the described embodiments. It is therefore intended that the foregoing description be regarded as illustrative rather than limiting, and that it be understood that all equivalents and/or combinations of embodiments are intended to be included in this description.

The invention claimed is:

1. A method for pulsed operation of a linear accelerator, the method comprising:

generating pulses of charged particles, the generating comprising emitting particles by a particle source and accelerating, in an accelerator device that comprises a plurality of linked cavity resonators, the particles, the accelerator device being supplied with energy by an energy supply unit;

adjusting an impedance of the accelerator device to the energy supply unit such that energy coupled into the accelerator device diminishes as a number of the particles emitted by the particle source per pulse increases; and changing a loading, wherein the supplying of the energy for the accelerator device is held constant, the changing of the loading comprising changing the loading such that energy of the particles is changed solely by varying the number of the particles emitted by the particle source per pulse, wherein the impedance is adjusted, and the loading is changed, such that effects of the adjusting and effects of the changing reinforce each other.

2. The method as claimed in claim 1, wherein the particles are accelerated by the accelerator device to an energy of more than 0.5 MeV.

3. The method as claimed in claim 2, wherein the particles are accelerated by the accelerator device to an energy of less than 30-50 MeV.

4. The method as claimed in claim 1, wherein the energy of the particles is changed solely by varying the number of particles emitted by the particle source per pulse by more than 1 MeV.

5. The method as claimed in claim 1, wherein the particle source emits pulses of charged particles with a frequency of more than 100 Hz.

6. The method as claimed in claim 2, wherein the energy of the particles is changed solely by varying the number of particles emitted by the particle source per pulse by more than 1 MeV.

7. The method as claimed in claim 3, wherein the energy of the particles is changed solely by varying the number of particles emitted by the particle source per pulse by more than 1 MeV.

8. The method as claimed in claim 2, wherein the particle source emits pulses of charged particles with a frequency of more than 100 Hz.

9. The method as claimed in claim 3, wherein the particle source emits pulses of charged particles with a frequency of more than 100 Hz.

10. The method as claimed in claim 4, wherein the particle source emits pulses of charged particles with a frequency of more than 100 Hz.

11. A linear accelerator comprising:

a particle source operable to emit a particle stream;

an accelerator device comprising a plurality of linked cavity resonators; and a control device operable to pulse the particle stream emitted by the particle source, wherein the control device and the accelerator device are configured to change an energy of particles solely by varying a number of particles emitted by the particle source per pulse.

12. The linear accelerator as claimed in claim 11, wherein the particle source comprises an electron source.

13. The linear accelerator as claimed in claim 11, wherein the control device is configured to generate a particular dose rate per pulse of emitted particles while keeping a high-frequency power fed to the accelerator device constant at a first lower particle energy or at a second higher particle energy.

14. The linear accelerator as claimed in claim 11, wherein an adjustment of an impedance of the accelerator device to the particle source is maximum at the lowest particle stream.

15. The linear accelerator as claimed in claim 12, wherein the control device is configured to generate a particular dose rate per pulse of emitted particles while keeping a high-frequency power fed to the accelerator device constant at a first lower particle energy or at a second higher particle energy.

16. The linear accelerator as claimed in claim 12, wherein an adjustment of an impedance of the accelerator device to the particle source is maximum at the lowest particle stream.

17. The linear accelerator as claimed in claim 13, wherein an adjustment of an impedance of the accelerator device to the particle source is maximum at the lowest particle stream.

18. In a non-transitory computer-readable storage medium that stores instructions executable by a control device for operating a linear accelerator, the instructions comprising:

generating pulses of charged particles, the generating comprising emitting particles by a particle source and accelerating, in an accelerator device that comprises a plurality of linked cavity resonators, the particles, the accelerator device being supplied with energy by an energy supply unit;

adjusting an impedance of the accelerator device to the energy supply unit such that energy coupled into the accelerator device diminishes as a number of the particles emitted by the particle source per pulse increases; and changing a loading, wherein the supplying of the energy for the accelerator device is held constant, the changing of the loading comprising changing the loading such that energy of the particles is changed solely by varying the number of the particles emitted by the particle source per pulse, wherein the impedance is adjusted, and the loading is changed, such that effects of the adjusting and effects of the changing reinforce each other.

* * * * *